US005745090A

United States Patent [19]

Kim et al.

[11] Patent Number: 5,745,090

[45] Date of Patent: Apr. 28, 1998

[54] WIRING STRUCTURE AND DRIVING METHOD FOR STORAGE CAPACITORS IN A THIN FILM TRANSISTOR LIQUID CRYSTAL DISPLAY DEVICE

[75] Inventors: Dong-Gyu Kim, Suwon; Sang-Chul Lee, Sungnam; Sang-Soo Kim, Seoul, all of Rep. of Korea

[73] Assignee: Samsung Electronics Co., Ltd., Kyungki-do, Rep. of Korea

[21] Appl. No.: 569,613

[22] Filed: Dec. 8, 1995

[30] Foreign Application Priority Data

Dec. 9, 1994 [KR] Rep. of Korea ..... 94-33515
Jan. 13, 1995 [KR] Rep. of Korea ..... 95-546

[51] Int. Cl.[6] ..... G09G 3/36

[52] U.S. Cl. ..... 345/90; 345/92; 349/39

[58] Field of Search ..... 345/92, 93, 90, 345/91, 98, 100, 87; 349/54, 38, 39, 46

[56] References Cited

U.S. PATENT DOCUMENTS 4,928,095 5/1990 Kawahara ..... 345/93
4,955,697 9/1990 Tsukada et al. ..... 345/92

*Primary Examiner*—Xiao Wu
*Attorney, Agent, or Firm*—Cushman Darby & Cushman IP Group of Pillsbury Madison & Sutro LLP

[57] ABSTRACT

A wiring structure and a driving method of a storage capacitor in a TFT-LCD eliminate the problem of a defective line dimly shown in first pixel row at a medium grey level, by using a typical gate line or a dummy pad. One side terminal of the storage capacitor is connected to a contact point between a drain terminal of a TFT and a liquid crystal capacitance, the other terminal of the storage capacitor is electrically connected to any gate line, from the second gate line to the final gate line.

13 Claims, 5 Drawing Sheets

WIRING STRUCTURE AND DRIVING METHOD FOR STORAGE CAPACITORS IN A THIN FILM TRANSISTOR LIQUID CRYSTAL DISPLAY DEVICE

BACKGROUND OF THE INVENTION (1) Field of the Invention

The present invention relates to a wiring structure and a driving method for storage capacitors in a thin film transistor liquid crystal display (hereinafter referred to as a TFT-LCD), more particularly, to a wiring structure and a driving method for storage capacitors in TFT-LCD which is capable of eliminating the problem of a defective line being dimly shown in first pixel row at a medium grey level, by using a typical gate line, without an additional processing or an additional external circuit.

(2) Description of the Prior Art

Following the current trend of miniaturizing household electric appliances, flat panel display devices have grown increasingly popular as substitutes for cathode ray tubes, and are now being produced on a commercial scale.

Liquid crystal displays, among the various types of flat panel displays, can be operated by a large scale integration (LSI) driver because of their characteristics, which are low-voltage and low-power consumption. Accordingly, LCDs have been widely applied to laptop computers, pocket computers, automobiles, and color televisions, etc.

TFT-LCDs have both a transistor and a storage capacitor in each pixel.

The transistor is made of a thin film, such as amorphous silicon, on a glass substrate, and uses twisted nematic (TN) liquid crystal.

Since a TFT-LCD can only turn on a pixel by inputting a signal for operating the transistor of each pixel, crosstalk is not generated.

In addition, each pixel includes a storage capacitor, e.g. of a thin film type, which is connected with a liquid crystal capacitance $C_{lc}$ in parallel. The storage capacitor stores an electric charge, so that the screen display is maintained during a non-selected period.

Depending on the wiring method of the storage capacitors, the TFT-LCDs including the storage capacitors have two driving methods, which are a common electrode method, and a previous gate method.

Technology about TFT-LCD using of the previous gate method is described in Korean Patent publication No. 94-254 publicated on Jan. 12, 1994, entitled "Driving device for matrix LCD and driving method for display device".

FIG. 1 is a detailed circuit diagram illustrating the wiring structure of a storage capacitor in a TFT-LCD using the prior art previous gate method.

For example, in a pixel of an nth gate line shown in FIG. 1, one terminal of the storage capacitor $C_s$ is connected to a contact point between a drain terminal of a TFT of which the gate is connected to the nth gate line $G_n$ of a gate driver and a liquid crystal capacitance $C_{lc}$, the other terminal of the storage capacitor $C_s$ is connected to the previous gate line $G_{n-1}$. The other terminal of the liquid crystal capacitance $C_{lc}$ is connected to a common electrode signal line $V_{com}$.

In the TFT-LCD using the previous gate method, the screen image is effected according to a wiring method of the storage capacitor $C_s$ responsive to the first gate line $G_1$ having no previous gate line.

As shown in FIG. 1, in the conventional TFT-LCD, one side terminal of the storage capacitor $C_s$ of the first gate line $G_1$ is connected to a contact point between a drain terminal of the TFT and a liquid crystal capacitance $C_{lc}$, the other side terminal thereof is connected to the common electrode signal line $V_{com}$.

To operate the liquid crystal display panel 15 through a data driver 14 having a low-voltage, below 5V, the common electrode signal $V_{com}$ having alternating waveforms should be applied to each horizontal scanning period. Furthermore, the off voltage $V_{off}$ of gate lines $G_1$, to $G_n$ should be applied as a signal having both a phase and an amplitude that are identical with that of the common electrode signal $V_{com}$.

For the reason that the phase and the amplitude of the common electrode signal $V_{com}$ are to be equal those of the off-voltage $V_{off}$, the storage capacitor $C_s$ is connected in parallel with the liquid crystal capacitance $C_{lc}$ in the pixel electrode, the electric potential of the pixel electrode is alternated by a capacitor coupling. At this time, the alternation should be identical with the phase and the amplitude in the common electrode signal $V_{com}$, so that a voltage difference between the pixel electrode and the common electrode is normally maintained. As a result, a constant electric field can be applied to a liquid crystal during a vertical scanning period.

However, in fact, as shown in FIG. 2, the phase and the amplitude of the common electrode voltage $V_{com}$ are not identical with that of the gate line off-voltage $V_{off}$. This is why resistance and capacitance between the two voltages $V_{com}$ and $V_{off}$ are different from each other.

For example, since a capacitance load applied to the common electrode ranges over the liquid crystal panel, the capacitance load is larger than that of one gate line by as much as 100 times. In addition, in general, the resistance load applied to the common electrode is smaller than that of the gate line.

Accordingly, conventionally, when expressing the pixel voltage as a multi-grey level, a minute difference is generated between the pixel voltage of a first row and the pixel voltage of another row because of a discordance between the common electrode voltage $V_{com}$ and the gate line off-voltage $V_{off}$. Accordingly, a brightness difference is generated between a pixel of a first row and a pixel of another row. That is, this is called as a line defect.

Furthermore, as shown in FIG. 3, the conventional TFT-LCD includes a data line 101; a gate line 102; an insulating layer/semiconductor layer 21; a drain electrode 22; a storage capacitor 24; and a pixel electrode 25.

When operating the conventional TFT-LCD shown in FIG. 3, then electric field from the gate driver 13 (FIG. 1) compensates the electric field of the storage capacitor $C_s$ (FIG. 1) through the gate line 102.

However, the electric field of the storage capacitor $C_s$ of the first gate line cannot be compensated by the gate driver 13, and is connected to the common electrode of the first gate line. Therefore, uniformity in response to the compensated electric potential difference between the first gate line and another gate line has been irregularly generated.

SUMMARY OF THE INVENTION

An object of the present invention is to provide a wiring structure and a driving method for storage capacitors in a TFT-LCD, which is capable of eliminating a defective line dimly shown in first pixel row at a medium grey level by using a typical gate line or a dummy pad, without additional processing or an additional external circuit.

In order to achieve this object, the present invention provides a wiring structure for a storage capacitor of a first gate line in a liquid crystal panel. In the wiring structure for the present invention, one side terminal of the storage capacitor is connected to a contact point between a drain terminal of a TFT and a liquid crystal capacitance, the other terminal of the storage capacitor is electrically connected to any gate line, from the second gate line to the final gate line.

The remaining gate lines after the second gate line use the second gate line. Also, in the liquid crystal panel, the remaining gate lines after the second gate line are electrically connected to one side terminal of the storage capacitor.

In addition, the remaining gate lines after the second gate line are electrically connected to one side terminal of the storage capacitor in a gate driver.

In order to achieve this object, a driving method for the present invention is that a storage capacitor of a pixel row in a first gate line is supplied with an electric signal through the remaining gate lines after a second gate line.

Another embodiment of the present invention in order to achieve this object includes a drive integrated circuit for compensating an electric field; a data line for transmitting data; a gate line for receiving an electric field from the drive integrated circuit and transmitting it; and an active area for compensating the electric field of the gate line, including a TFT, a storage capacitor, and a liquid crystal. The drive integrated circuit has a dummy pad to compensate the electric field of a storage capacitor connected to a first gate line.

DETAILED DESCRIPTION OF THE PREFERRED EMBODIMENT

Figure 1:
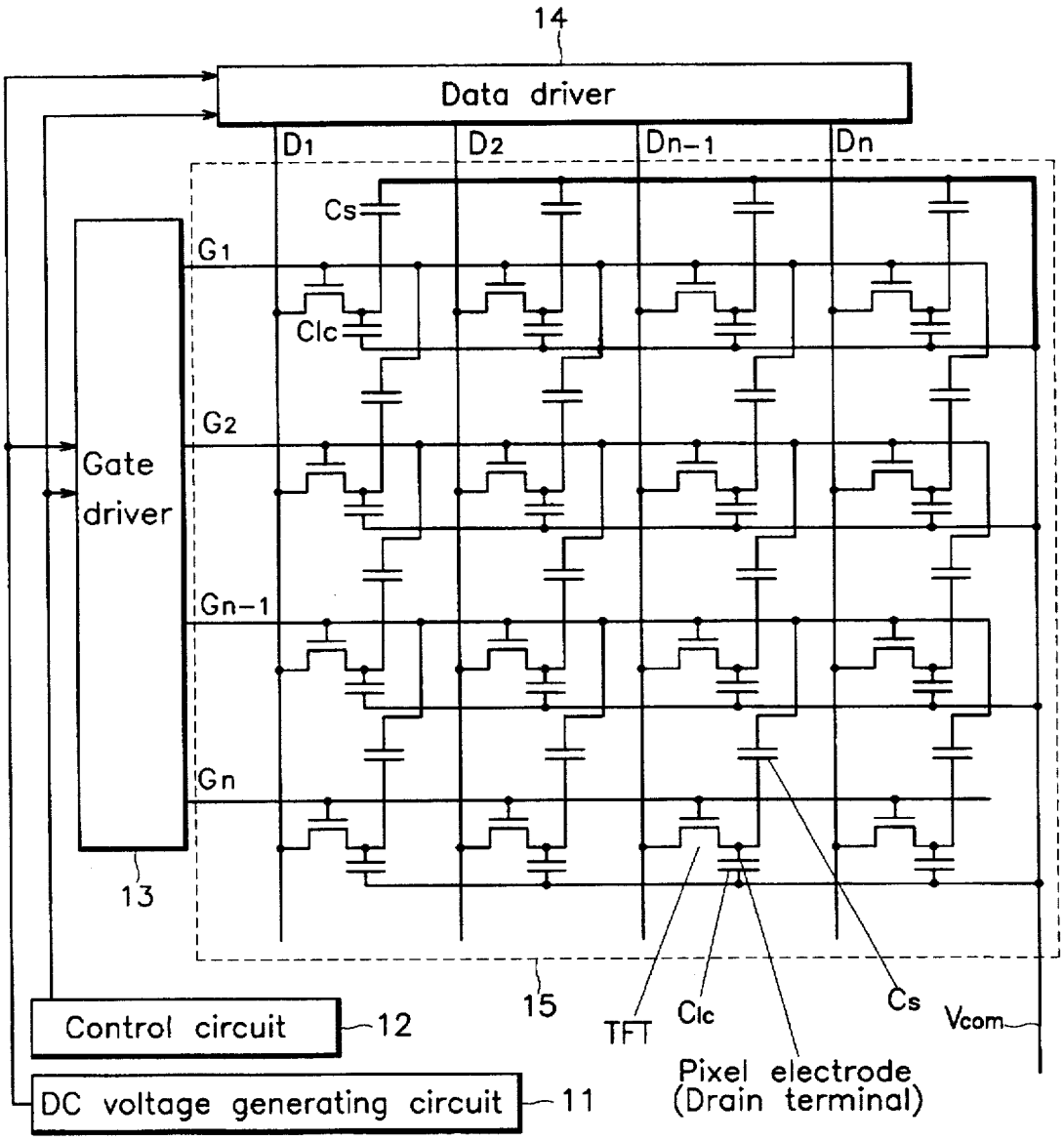
FIG. 1 (PRIOR ART)
FIG. 1 is a detailed circuit diagram illustrating a wiring structure of a storage capacitor in a conventional, prior art TFT-LCD.
Figure 2:
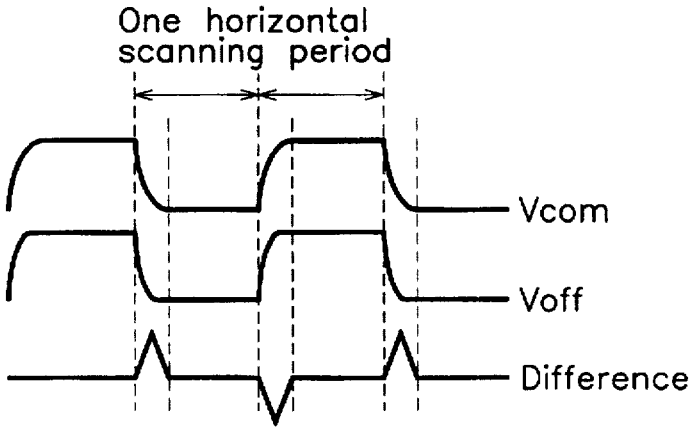
FIG.2 (PRIOR ART)
FIG. 2 is a waveform illustrating a discordance between a common electrode voltage and a gate line off-voltage in the conventional, prior art TFT-LCD of FIG. 1.
Figure 3:
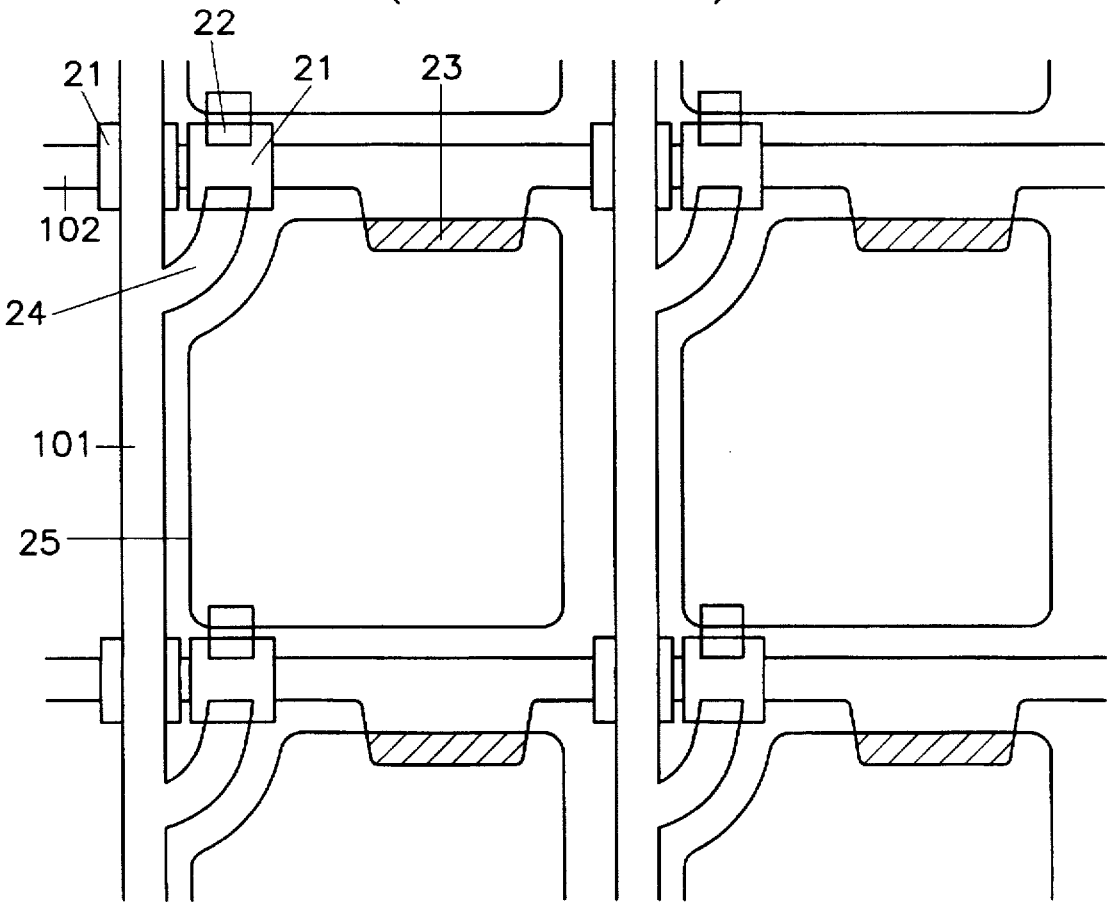
FIG.3 (PRIOR ART)
FIG. 3 shows a plan view of the conventional TFT-LCD of FIG. 1.
Figure 4:
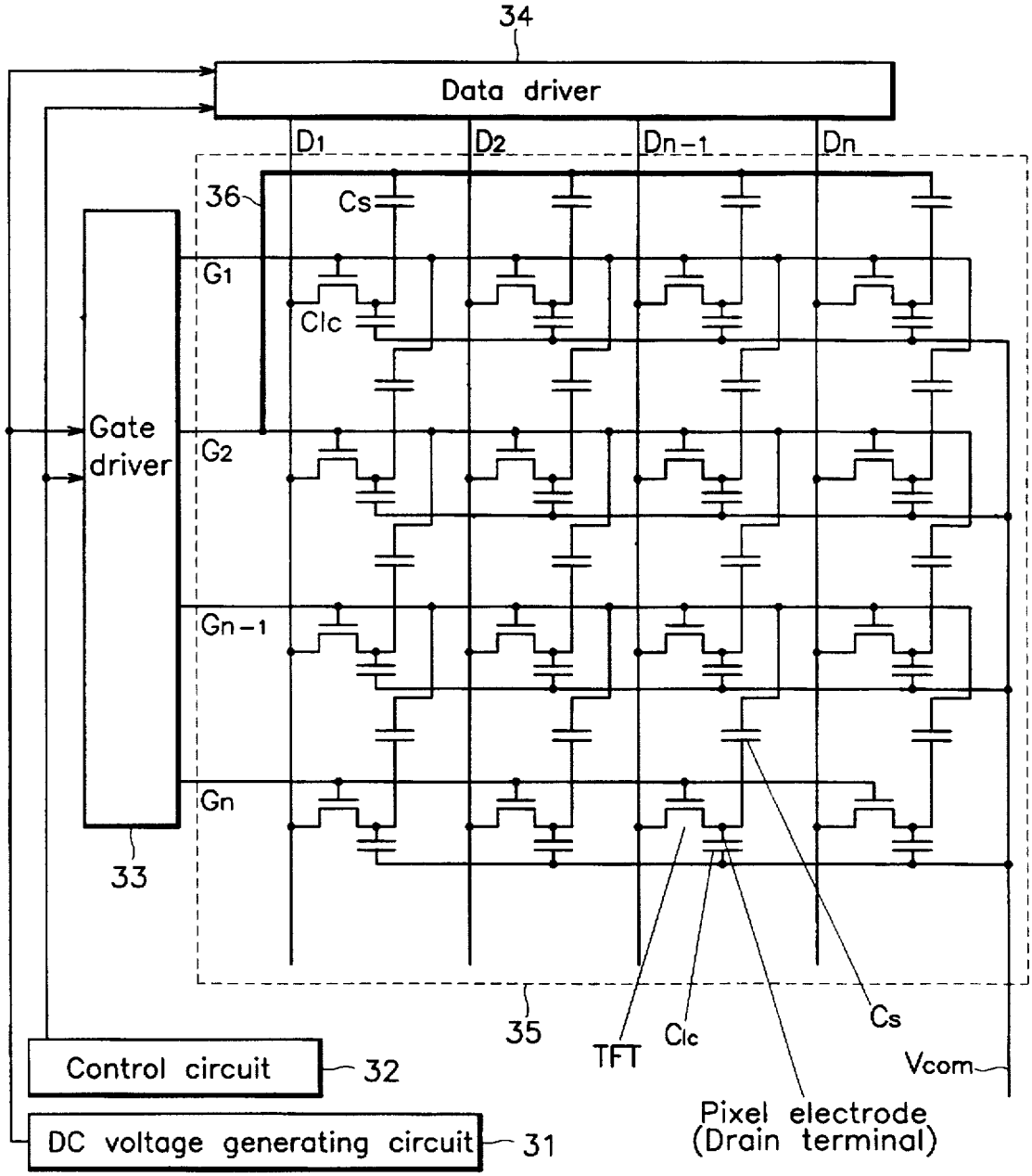
FIG. 4 is a detailed circuit diagram illustrating the wiring structure of a storage capacitor in a TFT-LCD provided in accordance with a first preferred embodiment of the present invention.

Referring to FIG. 4, the wiring structure of a storage capacitor in a TFT-LCD provided in accordance with a first preferred embodiment of the present invention is as follows. One terminal of a storage capacitor $C_s$ of the first gate line $G_1$ is connected to a contact point between a drain terminal of the TFT and a liquid crystal capacitance $C_{lc}$, and the other terminal thereof is connected to the second gate line $G_2$.

In the first preferred embodiment of the present invention, the second gate line $G_2$ of the gate driver 33 is connected to the storage capacitor $C_s$ of the first gate line $G_1$. However, the technical range of the present invention is not limited to this embodiment. Responsive to a need, any one gate line, from among the second gate line to the final gate line in a gate driver 33, may be connected to the storage capacitor $C_s$ of the first gate line $G_1$.

For example, when the storage capacitor $C_s$ is connected to the final gate line, the final gate line has no storage capacitor $C_s$, thereby miniaturizing total capacitance caused by two line connected to each other.

The wiring structure and the driving method of the storage capacitor in a TFT-LCD provided in accordance with the first preferred embodiment of the present invention is as follows.

Referring to FIG. 4, the liquid crystal display panel 35 may have a typical, known construction. A pixel located in a position (i,j) in the liquid crystal display panel 35 includes a TFT in the vicinity of a cross point between an ith gate line and a jth data line, one electrode of the TFT is connected to a pixel electrode provided as a transparent electrode, such as an indium tin oxide (ITO) electrode, or provided as an aluminum metal (Al) electrode. The liquid crystal capacitance $C_{lc}$ and the storage capacitor $C_s$ are connected to each other in parallel, centering around the pixel electrode.

The liquid crystal capacitance $C_{lc}$ is connected to a common electrode $V_{com}$, and the storage capacitor $C_s$ is connected to a previous gate line located in position (i−1).

After receiving a power-supply, the gate driver 33 successively outputs a scanning pulse to gate lines $G_1$ to $G_n$ of the liquid crystal panel 35.

The data driver 34 samples a video signal of a horizontal scanning period by means of a sample/hold circuit, and outputs the video signal to the data lines $D_1$ to $D_n$.

Both a control circuit 32 and a DC voltage generating circuit 31 are composed of a semiconductor element, such as an IC, and wiring, and n individual circuit element, in a printed circuit board PCB. They have a typical, known construction, so detailed explanations about them are omitted.

To drive the liquid crystal panel 35 through the data driver 34, having an output voltage of below 5V, both a common electrode signal $V_{com}$ and a gate line off-voltage $V_{off}$ should be applied to every each horizontal scanning period, as alternating signals having a same phase and a same amplitude.

As described above, for the reason that the phase and the amplitude of the common electrode signal $V_{com}$ are to be equal to these of the off-voltage $V_{off}$, the storage capacitor $C_s$ is connected in parallel with the liquid crystal capacitance $C_{lc}$ in the pixel electrode, and the electric potential of the pixel electrode is alternated by a capacitor coupling. At this time, the alternation should be identical with the phase and the amplitude in the common electrode signal $V_{com}$, so that the voltage difference between the pixel electrode and the common electrode is normally maintained.

In this case, in the first preferred embodiment of the present invention, the storage capacitor $C_s$ of a first row applies the gate line off-voltage $V_{off}$ into an electrode thereof, as another storage capacitor does. Accordingly, the electric potential of each pixel electrode in the first row is identical with that of pixels in other rows.

If the electric potential of a pixel electrode in the first row is identical with that of another row, the prior art problem of a defective line dimly shown in the first row disappears, thereby enhancing the image provided in the TFT-LCD.

In addition, since the first preferred embodiment only applies differently a wiring connection which is present in the prior art, it does not need an additional processing or a difficult processing. Furthermore, it does not need a circuit for accurately supplementing the pulses of both the common electrode voltage and the gate line off-voltage that have a different load to each other, so that the cost of production has been lowered.

Figure 5:
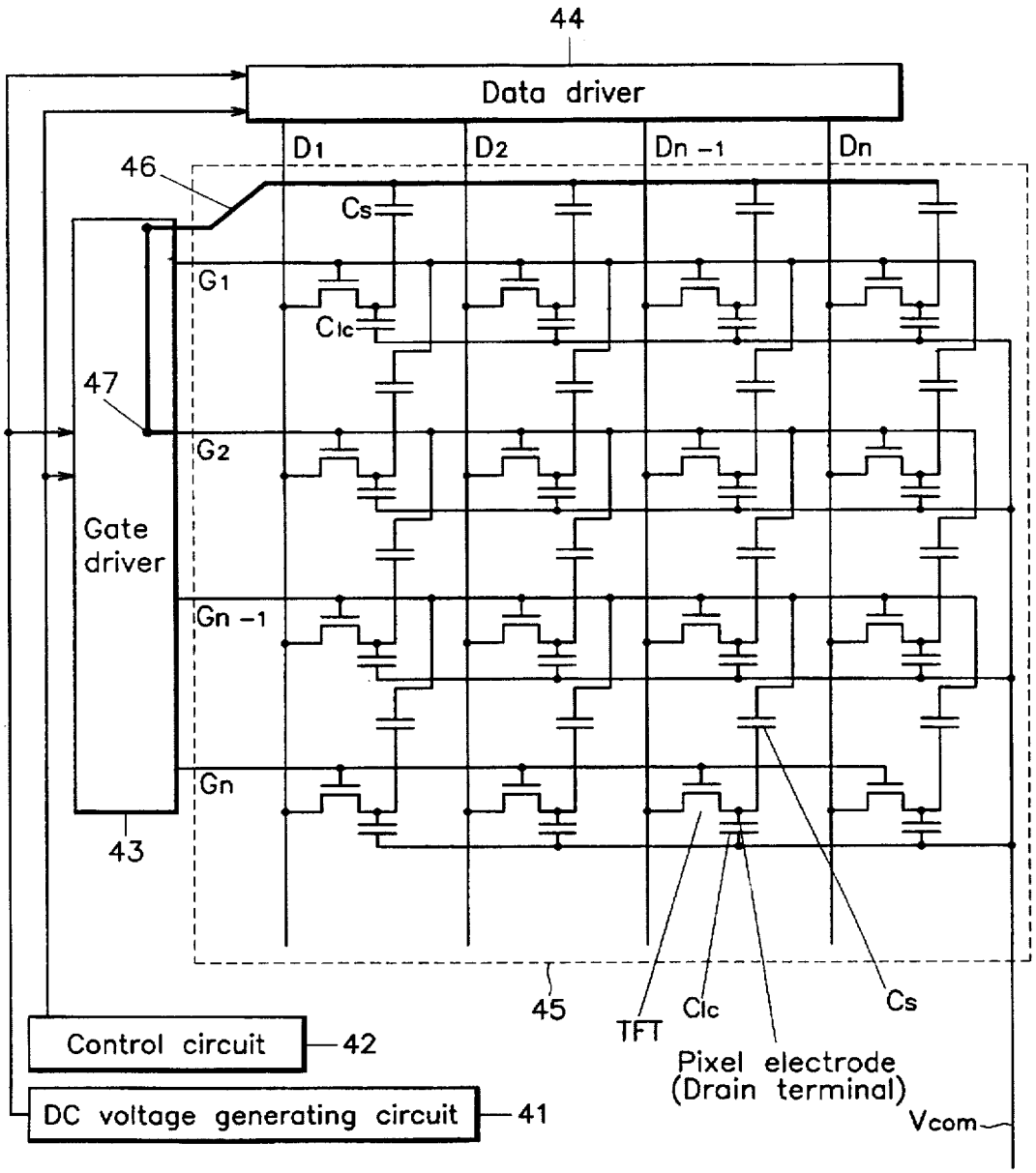
FIG. 5 is a detailed circuit diagram illustrating the wiring structure of a storage capacitor in a TFT-LCD provided in accordance with a second preferred embodiment of the present invention.

As shown in FIG. 5, a wiring structure of a storage capacitor in a TFT-LCD provided in accordance with a second preferred embodiment of the present invention is as follows. One terminal of a storage capacitor $C_s$ of the first gate line $G_1$ is connected to a contact point between a drain terminal of the TFT and a liquid crystal capacitance $C_{lc}$, and the other terminal thereof is connected to a gate line 46 which is electrically connected to the second gate line $G_2$ in the gate driver 43.

In the second preferred embodiment of the present invention, the gate line 46 in the gate driver 43 is electrically connected to an output terminal 47 toward a liquid crystal display panel of the second gate line $G_2$. However, the technical range of the present invention is not limited to this embodiment. Responsive to a need, the gate line 46 is connected to an output terminal of a selected gate line, of a liquid crystal display panel, after selecting one gate line from among the second gate line to the final gate line in a gate driver 43 to be connected to the storage capacitor $C_s$ of the first gate line $G_1$.

The wiring structure and the driving method of a storage capacitor $C_s$ in a TFT-LCD in accordance with the second preferred embodiment of the present invention are identical with those of the first preferred embodiment of the present invention as described above.

Figure 6:
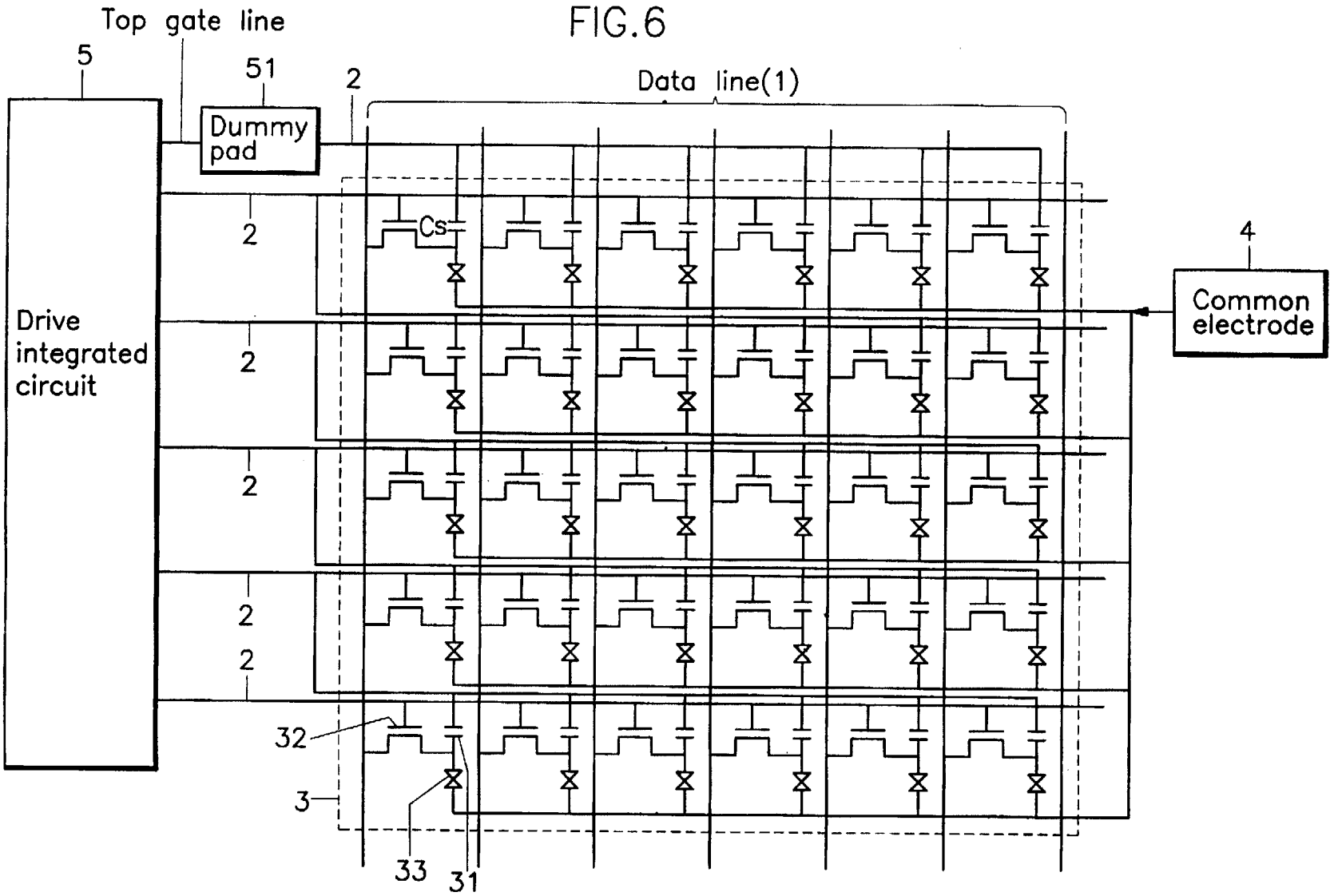
FIG. 6 is a wiring diagram illustrating the wiring structure of a storage capacitor in a TFT-LCD provided in accordance with a third preferred embodiment of the present invention.

As shown in FIG. 6, the wiring structure of a storage capacitor in a TFT-LCD provided in accordance with a third preferred embodiment of the present invention is as follows. A data line 1 is arranged in parallel and is arranged perpendicularly to a gate line 2. The gate line 2 is connected to a drive integrated circuit 5 for compensating the electric field of the gate line 2. In an active area 3, a storage capacitor 31, a TFT 32, and a liquid crystal 33 are connected under the gate line 2. The liquid crystal 33 is connected to a common electrode 4 applying the same voltage into all liquid crystals of the drive integrated circuit 5. The TFT 32 receives a reference voltage of the drive integrated circuit 5 through a dummy pad 51. The active area 3 receives data through the dummy pad of a data driver.

The operations of the wiring structure of the storage capacitor in a TFT-LCD provided in accordance with the third preferred embodiment of the present invention are as follows.

After receiving a power-supply, a reference voltage of the drive integrated circuit 5 is applied to the storage capacitor 31 in the active areas through all gate lines 2, so that the electric field is compensated.

The electric field of the input signal of the top gate line is also simultaneously compensated by the dummy pad 51 which receives the reference voltage of the drive integrated circuit 5. At this time, the input of the common electrode 4 is inputted through the liquid crystal 31 in the active area 3.

As described above, the present invention provides a wiring structure and a driving method for a storage capacitor in a TFT-LCD. It eliminates the problem of a defective line being dimly shown in first pixel row at a medium grey level, by using a typical gate line or a dummy pad, without an additional processing or an additional external circuit. Accordingly, it can be used for designing, manufacturing, and marketing a liquid crystal display panel.

What is claimed is:

1. A wiring structure for storage capacitors for pixels in a thin film transistor-liquid crystal display having a plurality of gate lines, wherein:

each said storage capacitor has one side terminal connected to a contact point between a drain terminal of a thin film transistor and a liquid crystal capacitance, each said storage capacitor being associated with a corresponding one of a first to a final gate line;

each said storage capacitor associated with the first gate line has another side terminal electrically connected to a gate line selected from any one of the second to the final gate lines; and each of said storage capacitors associated with the second to the final gate lines, respectively, has another side terminal electrically connected to the next preceding gate line.

2. The wiring structure as defined in claim 1, wherein: said selected gate line is said second gate line.

3. The wiring structure as defined in claim 1, wherein: said selected gate line is said final gate line.

4. The wiring structure as defined in claim 1, wherein: said gate lines are electrically connected to a gate driver.

5. A method for driving storage capacitors associated with a thin film transistor for pixels in a first through $n^{th}$ row of a liquid crystal display, served by gate lines, including:

supplying said storage capacitors in said first row with an electric signal through a selected gate line of said display other than said first gate line, said other selected gate line being electrically connected to one side terminal of said storage capacitors of the first row; and supplying said storage capacitors in the second through $n^{th}$ rows with an electric signal through a respective next preceding gate line.

6. The method of claim 5 comprising:

using said second gate line as said selected gate line.

7. The method of claim 5 comprising: using a final gate line as said selected gate line.

8. A wiring, structure of storage capacitors in a thin film transistor-liquid crystal display, comprising:

a drive integrated circuit for compensating an electric field;

a plurality of gate lines receiving said electric field from said drive integrated circuit and being electrically connected to respective rows of thin film transistors thereby transmitting said electric field to a gate of each thin film transistor in each respective row;

an active area for compensating said electric field of said gate lines, said active area including said thin film transistors connected with respective storage capacitors and liquid crystals;

each said storage capacitor connected to a first gate line having a side terminal electrically connected to a gate line selected from a second gate line to a final gate line, and each said storage capacitor connected to other gate lines having a side terminal electrically connected to a next respective preceding gate line.

9. The wiring structure as defined in claim 8, wherein said drive integrated circuit further comprises:

a dummy pad being connected to the drive integrated circuit for compensating an electric field of said first gate line outputted from said drive integrated circuit.

10. The wiring structure as defined in claim 8, wherein said selected gate line is said second gate line.

11. The wiring structure as defined in claim 8, wherein said selected gate line is said final gate line.

12. A wiring structure for in a thin film transistor-liquid crystal display, comprising:

an array of a plurality of thin film transistors arranged in a series of horizontal rows, and a series of vertical columns, said series of horizontal rows including a first row, a second row, and a plurality of successive rows after said second row, including a final row;

a liquid crystal panel juxtaposed with said array, so that a respective region of said panel located in juxtaposition with a respective thin film transistor, provides a respective pixel for said display;

a gate line for each said row, each gate line being operatively associated with a gate of each thin film transistor in each respective row;

a gate driver for said gate lines;

a data line for each said column, each data line being operatively associated with a source terminal of each thin film transistor in each respective column;

a data driver for said data lines;

each of the thin film transistors having a drain terminal connected via a liquid crystal capacitance to a common electrode signal line;

a storage capacitor for each said thin film transistor; each of the storage capacitors for the thin film transistors of said rows excluding said first row having one side terminal connected to a respective contact point between a respective thin film transistor drain terminal and a respective liquid crystal capacitance, and another side terminal connected to the respective said gate line serving the respective next preceding one of said rows; and the storage capacitors for the thin film transistors of said first row each having one side terminal connected to a respective contact point between a respective thin film transistor drain terminal and a respective liquid crystal capacitance, and another side terminal connected to one of said gate lines serving a row other than said first row.

13. The wiring structure of claim 12, wherein:

said row other than said first row is said second row.

* * * * *